US009221574B2

(12) United States Patent
Sakaino et al.

(10) Patent No.: US 9,221,574 B2
(45) Date of Patent: Dec. 29, 2015

(54) LABEL PRINTER

(71) Applicants: SANEI ELECTRIC INC., Tokyo (JP); DATECS Ltd., Sofia (BG)

(72) Inventors: Tsuyoshi Sakaino, Tokyo (JP); Mikio Moriya, Tokyo (JP)

(73) Assignees: SANEI ELECTRIC INC., Tokyo (JP); DATECS Ltd., Sofia (BG)

( * ) Notice: Subject to any disclaimer, the term of this patent is extended or adjusted under 35 U.S.C. 154(b) by 0 days.

(21) Appl. No.: 14/615,994

(22) Filed: Feb. 6, 2015

(65) Prior Publication Data

US 2015/0225105 A1 Aug. 13, 2015

(30) Foreign Application Priority Data

Feb. 13, 2014 (JP) ..... 2014-025467

(51) Int. Cl.

| | |
|---|---|
| ***B65C 9/46*** | (2006.01) |
| ***B65C 11/02*** | (2006.01) |
| ***B41J 15/04*** | (2006.01) |
| ***B65H 41/00*** | (2006.01) |
| ***B65C 9/40*** | (2006.01) |
| ***B65C 9/00*** | (2006.01) |
| ***B41J 3/407*** | (2006.01) |
| ***B41J 11/00*** | (2006.01) |

(52) U.S. Cl.

CPC ..... *B65C 9/46* (2013.01); *B41J 3/4075* (2013.01); *B41J 11/0095* (2013.01); *B41J 15/042* (2013.01); *B65C 9/0006* (2013.01); *B65C 9/40* (2013.01); *B65C 2009/0093* (2013.01)

(58) Field of Classification Search

CPC ..... B65C 9/00; B65C 9/18; B65C 9/40; B65C 9/46; B65C 9/0006; B65C 11/02; B65C 2009/0093; B41J 15/04; B41J 15/16; B41J 15/042; B41J 3/4075; B65H 41/00

USPC ..... 400/642–644

See application file for complete search history.

(56) References Cited

U.S. PATENT DOCUMENTS

| | | | | |
|---|---|---|---|---|
| 5,150,130 | A * | 9/1992 | Sato | 347/222 |
| 5,980,138 | A | 11/1999 | Shiozaki et al. | |
| 6,261,013 | B1 * | 7/2001 | Bryer et al. | 400/613 |
| 2004/0079490 | A1 * | 4/2004 | Ito | 156/584 |
| 2006/0008311 | A1 * | 1/2006 | Miyasaka et al. | 400/613 |

(Continued)

FOREIGN PATENT DOCUMENTS

| | | | | |
|---|---|---|---|---|
| DE | 19507892 | A1 * | 9/1996 | B65C 9/00 |
| JP | 08230275 | A * | 9/1996 | B41J 5/04 |

(Continued)

*Primary Examiner* — Nguyen Ha
*Assistant Examiner* — Wyn Ha
(74) *Attorney, Agent, or Firm* — Young Law Firm, P.C.

(57) ABSTRACT

A label printer is provided with a printer body that includes a paper roll holder; a label printing unit that includes a print head; a platen roller that sends the paper strip in a first direction after the paper strip passes through the print head; a cover that opens or closes the paper roll holder; and a removal unit that peels off the label from the paper strip. One end of the cover is pivotally supported on the printer body via a first rotation shaft that is parallel to a central axis of the paper roll. One end of a longitudinal side of the removal unit is pivotally supported on the cover via a second rotation shaft that is perpendicular to the first rotation shaft. A locking mechanism that engages with the cover is provided at the other end of the longitudinal side of the removal unit.

6 Claims, 6 Drawing Sheets

(56) References Cited

U.S. PATENT DOCUMENTS

| | | | | |
|---|---|---|---|---|
| 2006/0039737 | A1* | 2/2006 | Takami et al. | 400/613 |
| 2006/0151118 | A1* | 7/2006 | Murata et al. | 156/379 |
| 2006/0162842 | A1* | 7/2006 | Hiroike et al. | 156/64 |
| 2006/0165467 | A1* | 7/2006 | Kawakami et al. | 400/613 |
| 2007/0003354 | A1* | 1/2007 | Tamura et al. | 400/621 |
| 2009/0214280 | A1* | 8/2009 | Mistyurik et al. | 400/207 |
| 2010/0247219 | A1* | 9/2010 | Takabatake et al. | 400/611 |
| 2011/0214820 | A1* | 9/2011 | Sato | 156/764 |
| 2013/0084121 | A1* | 4/2013 | Watanabe | 400/642 |
| 2013/0108346 | A1* | 5/2013 | Preliasco et al. | 400/611 |
| 2015/0165797 | A1* | 6/2015 | Chari et al. | |

FOREIGN PATENT DOCUMENTS

| | | | | | |
|---|---|---|---|---|---|
| JP | H08-295323 | | | 11/1996 | |
| JP | 11193014 | A | * | 7/1999 | B65C 11/02 |
| JP | H11-314624 | | | 11/1999 | |
| JP | 2000095223 | A | * | 4/2000 | B65C 9/18 |
| JP | 2001018940 | A | * | 1/2001 | B65C 9/46 |
| JP | 2004237621 | A | * | 8/2004 | B41J 5/04 |
| JP | 2006021439 | A | * | 1/2006 | B41J 5/04 |
| JP | 2007185774 | A | * | 7/2007 | B65H 41/00 |
| JP | 2008062632 | A | * | 3/2008 | B41J 15/04 |

* cited by examiner

LABEL PRINTER

BACKGROUND OF THE INVENTION

1. Field of the Invention

The present invention relates to a label printer, and particularly to a label printer that can switch between a continuous issuing function of issuing a label that remains temporarily attached to a strip of paper and a removal issuing function of issuing a label after taking the label off the paper.

2. Description of Related Art

A removal issuing function has been known as one function of a label printer that issues a label that remains temporarily attached to a strip of paper after printing the label. This function is to issue a label after taking the label off the paper. The label printer switches between the continuous issuing mode of issuing a label that remains temporarily attached to the paper, and the removal issuing mode of issuing a label after taking the label off the paper, if necessary.

For example, a label printer disclosed in Japanese Patent Application Laid-Open No. H08-295323 has a removal issuing mode and a continuous issuing mode. When the label printer is used in removal issuing mode, a cover is opened, and a paper roll is housed in a hopper of a printer body. Then, in a wide space where the cover is being opened, the tip of a paper is pulled out until the tip reaches a position where the paper covers a platen roller and a label removal member. The tip of the paper does not pass through a label issuing opening when the cover is closed. As a result, the tip side of the paper is bent at an acute angle by the label removal member, and the paper passes between a pinch roller and the platen roller. In this manner, the paper is set on a removal-issuing paper route in such a way that the paper is pulled out via a paper exit opening.

When the label printer is used in continuous issuing mode, the cover is opened, and a paper roll is housed in the hopper. Then, in the wide space where the cover is being opened, the tip of a paper is pulled out until the tip reaches a position where the paper slightly protrudes from the label removal member. The tip of the paper is forced through the label issuing opening before the cover is closed. As a result, the paper is not bent by the label removal member; the paper is set on a continuous-issuing paper route on the label issuing opening's side in such a way that the paper is directly pulled out along with the label.

In the conventional label printer disclosed in Japanese Patent Application Laid-Open No. H08-295323, the setting of the removal issuing mode is completed only by setting the paper roll in the hopper of the printer body and closing the cover. Therefore, the advantage is that the operability is good when the label printer is used in removal issuing mode. However, when the label printer is used in continuous issuing mode, the label paper needs to be inserted into the paper exit opening. Therefore, the operability is not good when the label printer switches to the continuous issuing mode. Japanese Patent Application Laid-Open No. H11-314624 discloses a label printer whose operability has been improved when switching to the continuous issuing mode.

In the label printer disclosed in Japanese Patent Application Laid-Open No. H11-314624, with respect to a printer body in which a continuous label strip is mounted, a cover that is to be opened or closed is divided into an open cover and a removal cover. In removal issuing mode, a switching lever is operated to fix the removal cover to the open cover, so that the covers can be opened or closed as one unit. In continuous issuing mode, the switching lever is operated to fix the removal cover to the printer body, so that only the open cover can be opened or closed. In this manner, the only thing that is required to switch between the removal issuing mode and the continuous issuing mode is to operate the switching lever and open or close the open cover.

In the conventional label printers disclosed in Japanese Patent Application Laid-Open No. H08-295323 and Japanese Patent Application No. H11-314624, the platen roller is placed on the printer body's side, and a thermal head is placed on the cover's side, and a removal roller is disposed on the cover's side. Therefore, the removal roller can be pressed against the platen roller across the label paper only after the cover is closed. Thus, the advantage is that the operability is good when the label printer is used in removal issuing mode.

However, the label printer disclosed in Japanese Patent Application No. H11-314624 is configured in such a way that a large cover thereof is opened in a lateral direction. Therefore, the balance of the left and right portions is not good when the cover is opened, and the problem is that the cover is difficult to open. Moreover, since the appearance thereof is left-right asymmetric, the costs of design and production become high. Furthermore, the small lever needs to be operated to switch between the modes, and the operability should be further improved.

SUMMARY

The object of the present invention is to provide a label printer whose operability has been improved when being used in removal issuing mode.

To solve the above problems, a label printer of the present invention includes: a printer body that includes a paper roll holder; a label printing unit that includes a print head to print a label that remains temporarily attached to a paper strip that is fed from a paper roll in the paper roll holder; a platen roller that sends the paper strip in a first direction after the paper strip passes through the print head; a cover that opens or closes the paper roll holder; and a removal unit that peels off the label from the paper strip, wherein one end of the cover is pivotally supported on the printer body via a first rotation shaft that is parallel to a central axis of the paper roll, one end of a longitudinal side of the removal unit is pivotally supported on the cover via a second rotation shaft that is perpendicular to the first rotation shaft, and a locking mechanism that engages with the cover is provided at the other end of the longitudinal side of the removal unit.

According to the present invention, separately from the operation of opening or closing the cover, the removal unit can be dynamically opened or closed. Therefore, it is possible to eliminate delicate operations such as those for switching switches, and to offer very simple and easy-to-understand operability.

In the present invention, the removal unit preferably includes: a removal roller that sends the paper strip in a second direction that is different from the first direction in such a way that the paper strip is being held between the removal roller and the platen roller, and peels off the label from the paper strip; a label detection sensor that detects a state of the label being discharged through a first paper sheet exit opening located in the first direction; a paper detection sensor that detects whether or not the paper strip is being discharged through a second paper sheet exit opening located in the second direction; and a frame on which the removal roller, the label detection sensor, and the paper detection sensor are mounted. According to this configuration, most of components necessary for the label removal issuing operation concentrate in the removal unit. This configuration therefore makes the maintenance and replacement of the removal unit easier.

In the present invention, the removal unit is preferably provided on the cover in a detachable manner. According to this configuration, the removal unit can be completely detached from the printer body. This configuration therefore makes the maintenance and replacement of the removal unit easier. Moreover, the label printer can be used as a printer with no removal issuing function.

According to the present invention, it is possible to provide a label printer whose operability has been improved when being used in removal issuing mode.

DETAILED DESCRIPTION OF THE EMBODIMENTS

Preferred embodiments of the present invention will be explained below in detail with reference to the accompanying drawings.

Figure 1:
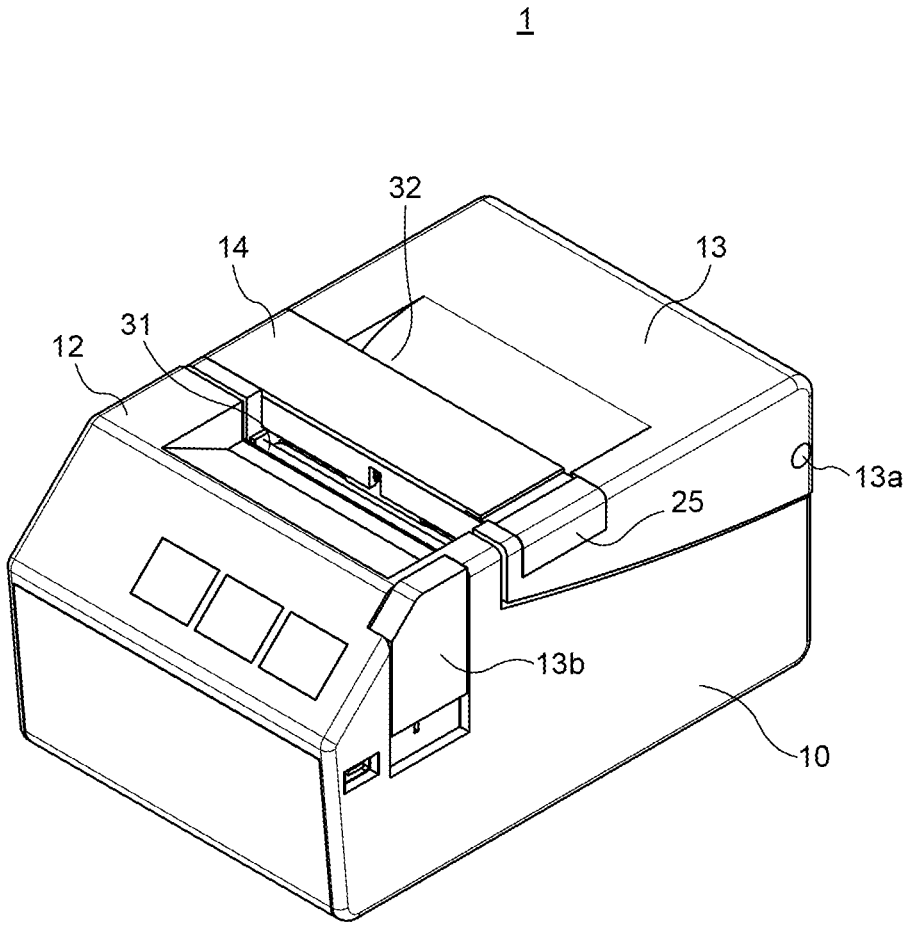
FIG. 1 is a schematic perspective view showing a configuration of a label printer, specifically in a situation where a cover is closed, according to a preferred embodiment of the present invention.
Figure 2:
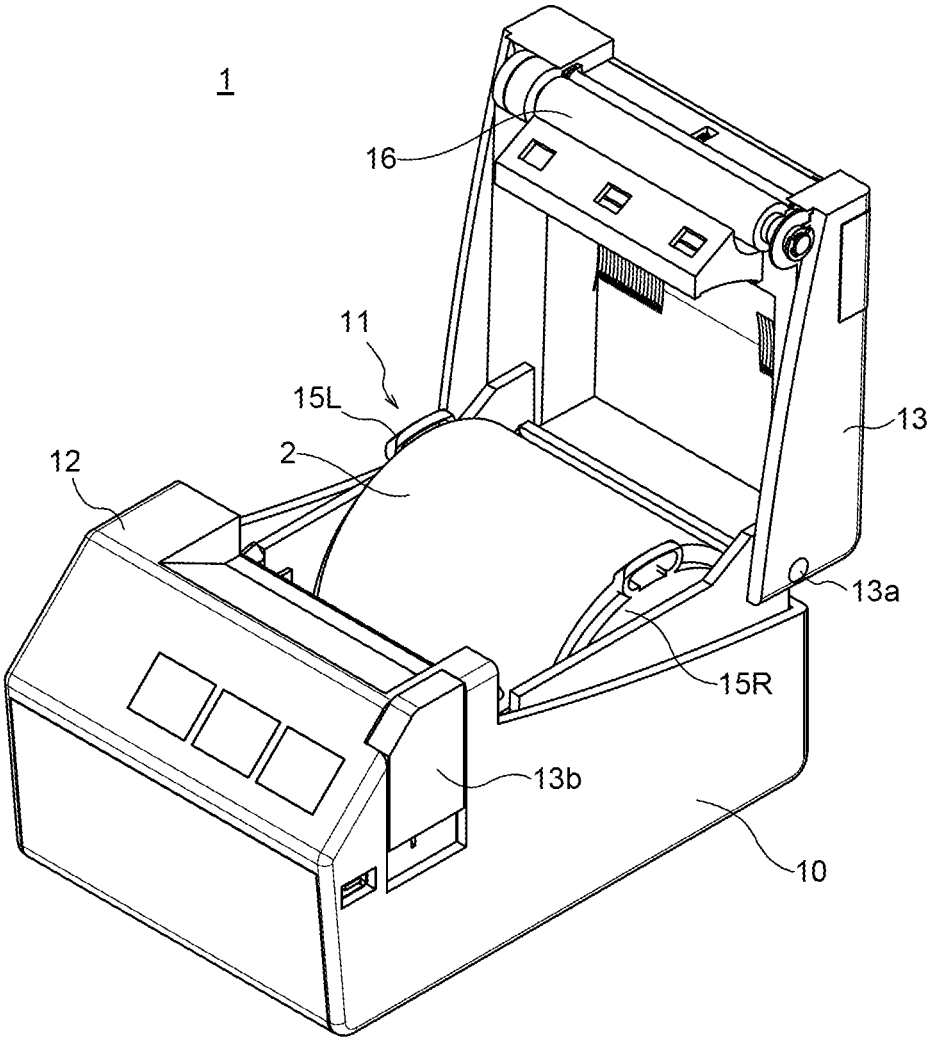
FIG. 2 is a schematic perspective view showing the configuration of the label printer, specifically in a situation where the cover is opened, according to a preferred embodiment of the present invention.

FIGS. 1 and 2 are schematic perspective views showing a configuration of a label printer according to a preferred embodiment of the present invention. Specifically, FIG. 1 shows a situation where a cover is closed and FIG. 2 shows a situation where the cover is opened.

As shown in FIGS. 1 and 2, a label printer 1 includes a printer body 10, which includes a paper roll holder 11; a label printing unit 12, which includes a thermal head (print head); a cover 13, which is provided above the paper roll holder 11; and a removal unit 14, which is provided on an upper surface of the cover 13. The paper roll holder 11 is located in a rear portion of the printer body 10. The label printing unit 12 is provided in a front portion of the printer body 10 in such a way as to be located ahead of the paper roll holder 11. A rotation shaft 13*a* of the cover 13 is provided in a rear end portion of the printer body 10. When an unlocking button 13*b* is pushed, the cover 13 is unlocked with respect to the printer body 10; the cover 13 can be opened by lifting up a front end portion of the cover 13.

The removal unit 14 is provided to peel off a label from a paper strip when the label on the paper strip is fed from a paper roll 2 in removal issuing mode. While the details will be described later, one end of a longitudinal side of the removal unit 14 is pivotally supported on the cover 13 via a rotation shaft. At the other end of the longitudinal side of the removal unit 14, an open knob 25 is provided as a locking mechanism. The removal unit 14 is provided in such a way as to bridge over in the width direction of the cover 13.

Figure 5:
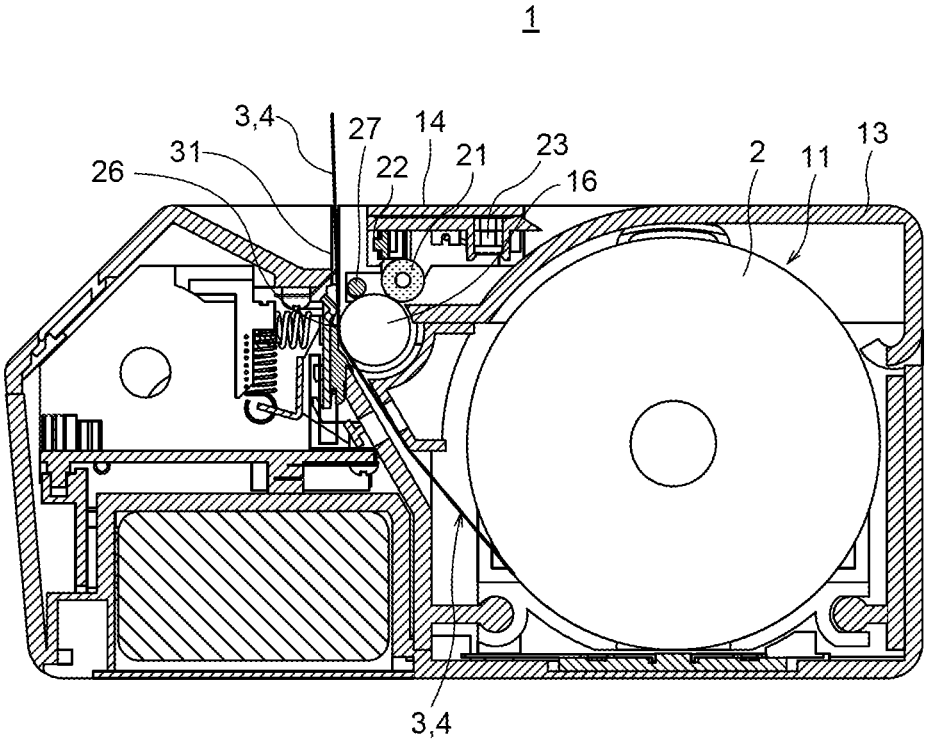
FIG. 5 is a schematic side cross-sectional view for explaining the operation of the continuous issuing mode.
Figure 6:
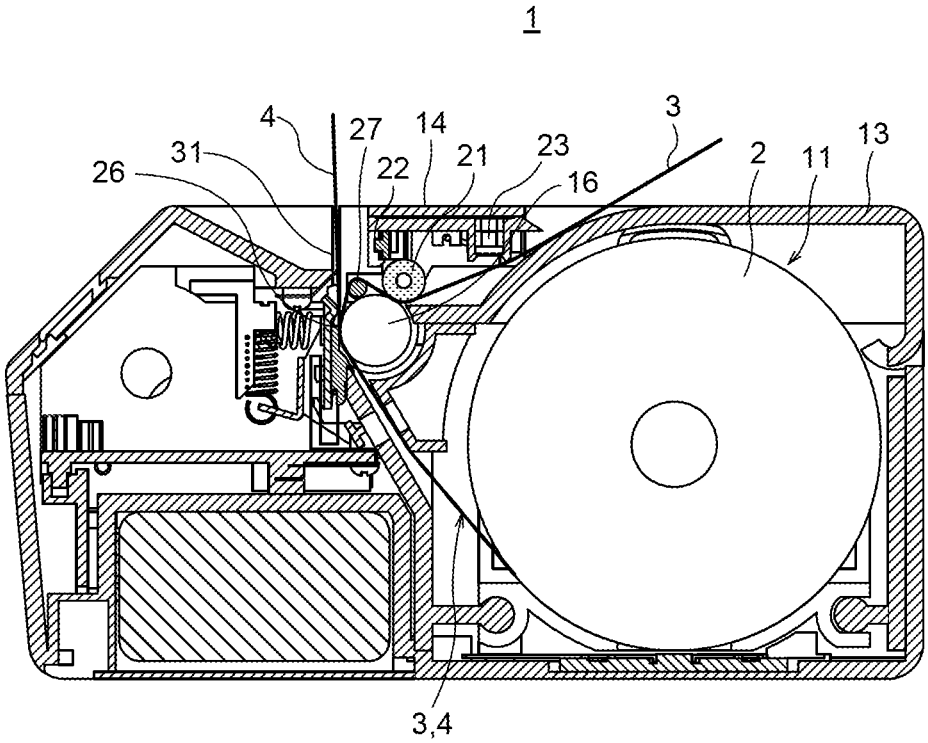
FIG. 6 is a schematic side cross-sectional view for explaining the operation of the removal issuing mode.

The paper roll 2 is housed in the paper roll holder 11. A pair of paper guides 15L and 15R are provided on both sides of the paper roll 2 in the width direction. The paper guides 15L and 15R are in contact with both sides of the paper roll 2 in order to prevent a positional shift of the paper roll 2 in a central axis direction. In a front end portion of the cover 13, a platen roller 16 is mounted. The platen roller 16 is positioned in such a way as to face a thermal head 26 (as shown in FIGS. 5 and 6) of the label printing unit 12 when the cover 13 is closed.

Figure 3:
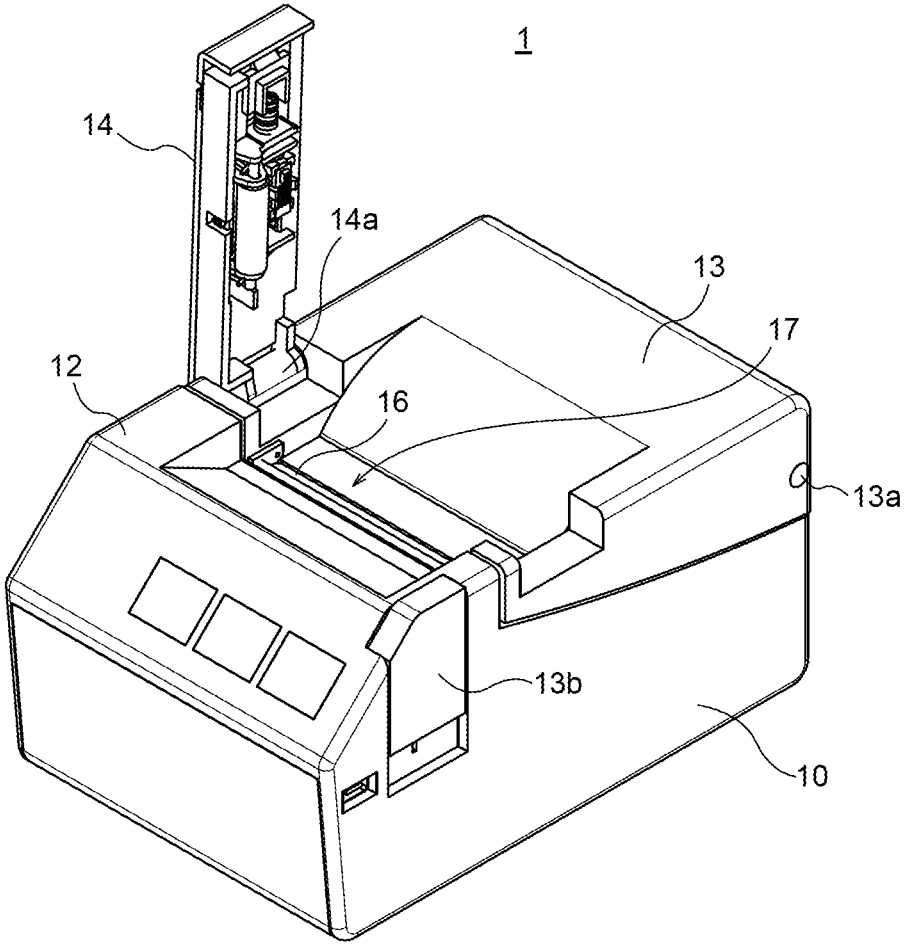
FIG. 3 is a schematic perspective view showing a situation where the removal unit of the label printer is opened.

FIG. 3 is a schematic perspective view showing a situation where the removal unit 14 of the label printer 1 is opened.

As shown in FIGS. 1 and 3, the removal unit 14 is pivotally supported on the cover 13 via a rotation shaft 14*a*. The rotation shaft 14*a* of the removal unit 14 extends in a direction perpendicular to the direction of the rotation shaft 13*a* of the cover 13 (or in a direction perpendicular to the central axis direction of the paper roll 2). When the removal unit 14 is closed, the removal unit 14 is disposed in such a way as to traverse the cover 13 in the width direction thereof; the space between the cover 13 and the removal unit 14 serves as a removal-issuing paper route 17. As the removal unit 14 is opened, the removal-issuing paper route 17 is opened. Therefore, the paper strip that is pulled out from the paper roll 2 can be easily set.

Figure 4:
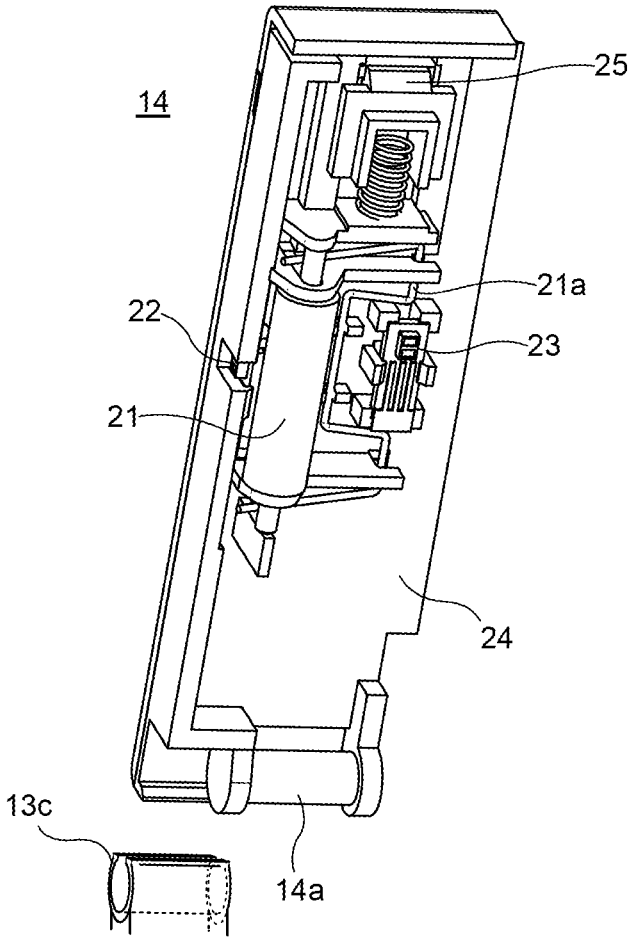
FIG. 4 is a schematic perspective view detailing the configuration of the removal unit.

FIG. 4 is a schematic perspective view detailing the configuration of the removal unit 14.

As shown in FIG. 4, the removal unit 14 includes a removal roller 21, which peels off the label from the paper strip in removal issuing mode and forwards the paper, from which the label has been removed, to the removal-issuing paper route 17; a label detection sensor 22, which detects the discharge state of the label in removal issuing mode; a paper detection sensor 23, which detects whether there is a paper strip passing through the removal-issuing paper route 17; a resin frame 24, on which the removal roller 21, the label detection sensor 22, and the paper detection sensor 23 are mounted. In one end of a longitudinal side of the frame 24, the rotation shaft 14*a* is provided. In the other end of the longitudinal side of the frame 24, an unlocking open knob 25 is provided. When the open knob 25 engages with the cover 13, the frame 24 is fixed to the cover 13. When the engagement of the open knob 25 is released, the frame 24 is unlocked. Incidentally, the type of the locking mechanism is not specifically limited in the present invention.

The removal roller 21 is pressed by a removal roller pressing spring 21*a* against the platen roller 16. When the removal unit 14 is closed, the removal roller 21 is pressing the platen roller 16. The paper strip is carried due to a frictional force generated by the pressing force against the platen roller 16. The paper strip is discharged through an exit opening of the removal-issuing paper route 17. In the present embodiment, a wire spring is used as the removal roller pressing spring 21*a*. However, a compression spring or other pressing means may be used.

It is preferred that the removal unit 14 is freely attachable and detachable from the cover 13. Although not specifically limited, the rotation shaft 14*a* of the removal unit 14 can be attached by one-touch operation to a fitting portion 13*c* that is substantially C-shaped in cross section and provided on the cover 13's side. According to this configuration, the removal unit 14 can be completely detached from the printer body. Most of components necessary for the label removal issuing operation concentrate in the removal unit 14. This configuration therefore makes the maintenance and replacement of the removal unit 14 easier. Moreover, the label printer can be used as a printer with no removal issuing function.

In the present embodiment, the rotation shaft 13*a* of the cover 13 is parallel to the central axis of the paper roll 2 in the paper roll holder 11. By moving the cover 13 in an up-down direction, the cover 13 can be opened. Accordingly, it is easy to open or close the cover 13, as well as to put the paper roll 2. The design is also left-right symmetric, thereby ensuring stability. The rotation shaft 14*a* of the removal unit 14 is perpendicular to the rotation shaft 13*a* of the cover 13. By moving the removal unit 14 in a left-right direction of the printer, the removal unit 14 can be opened. Separately from the operation of opening or closing the cover 13, the removal unit 14 can be dynamically opened or closed. Therefore, it is possible to eliminate delicate operations such as those for switching switches, and to offer very simple and easy-to-understand operability.

In the above-described configuration, the setting method for the label printer 1 in continuous issuing mode is as follows: The paper roll 2 is set in the paper roll holder 11, and the end (paper strip) of the paper roll 2 is pulled out of the paper roll holder 11, and then the cover 13 is closed. As a result, the paper strip is pulled out of a first paper sheet exit opening 31 between the label printing unit 12 and the cover 13.

The setting method for the label printer 1 in removal issuing mode is as follows: The paper roll 2 is set in the paper roll holder 11, the end (paper strip) of the paper roll 2 is pulled out of the paper roll holder 11, the cover 13 is closed, the removal-issuing paper route 17 is opened by opening the removal unit 14, the paper strip is pulled in such a way to pass over the platen roller 16 and the removal-issuing paper route 17, and the removal unit 14 is closed in such a way that the paper strip is trapped into the removal-issuing paper route 17. As a result, the paper strip passes between the removal roller 21 and the platen roller 16, and is pulled out of a second paper sheet exit opening 32 between the cover 13 and the removal unit 14.

FIG. 5 is a schematic side cross-sectional view for explaining the operation of the continuous issuing mode. FIG. 6 is a schematic side cross-sectional view for explaining the operation of the removal issuing mode.

As shown in FIGS. 5 and 6, the removal unit 14 is located outside the cover 13. Accordingly, the removal roller 21, the label detection sensor 22, and the paper detection sensor 23 are located outside the cover 13. When the removal unit 14 is closed, the removal roller 21 is in contact with an upper portion of the platen roller 16. The removal-issuing paper route 17 extends to the rear side of the cover 13 after passing between the platen roller 16 and the removal roller 21. The upper surface of the cover 13 makes up a bottom surface of the removal-issuing paper route 17.

As shown in FIG. 5, the paper strip 3, which is the end section of the paper roll 2 housed in the paper roll holder 11, is sent upward after passing between a thermal head 26 and the platen roller 16. During this process, the label is printed. Then, in the case of the continuous issuing mode, the printed label 4 travels straight and upward (or in a first direction) along with the paper strip 3. The printed label 4 is sent to the first paper sheet exit opening 31, and is discharged together with the paper strip 3.

As shown in FIG. 6, the paper strip 3, which is the end section of the paper roll 2 housed in the paper roll holder 11, is sent upward after passing between the thermal head 26 and the platen roller 16. During this process, the label is printed. Then, in the case of the removal issuing mode, the printed label 4 is removed from the paper strip 3 at a position where the paper strip 3 is abruptly bent. The printed label 4 travels straight and upward (or in the first direction) separately from the paper strip 3. The printed label 4 is sent to the first paper sheet exit opening 31.

Meanwhile, the paper strip 3 is bent at an acute angle at the position of a removable bar 27, which is located above the platen roller 16. The paper strip 3 passes between the platen roller 16 and the removal roller 21, and is sent to the second paper sheet exit opening 32. That is, the traveling direction of the paper strip 3 is changed in such a way that the paper strip 3 travels in a direction (second direction) that is different from the traveling direction (first direction) of the printed label 4. Accordingly, the printed label 4 is discharged separately from the paper strip 3.

In removal issuing mode, the discharge state of the printed label 4 is detected by the label detection sensor 22, and the forwarding of the printed label is controlled to ensure that the printed label stops at an appropriate position. As a result, a user of the label printer 1 can easily peel off the label from the paper strip 3 and use the label.

In order to determine the issuing mode, the paper detection sensor 23 is used. If the paper detection sensor 23 detects the existence of the paper strip 3, the issuing mode is set to the removal issuing mode. If the paper detection sensor 23 does not detect the existence of the paper strip, the issuing mode is set to the continuous issuing mode.

As described above, in the label printer 1 of the present embodiment, the thermal head 26 is disposed on the printer body's side, and the platen roller 16 is disposed on the cover 13's side. The removal unit 14 is mounted on the cover 13 in such a way as to be able to be opened or closed. Therefore, it is possible to offer improved operability for setting the paper strip when the label printer is to operate in removal issuing mode.

It is apparent that the present invention is not limited to the above embodiments, but may be modified and changed without departing from the scope and spirit of the invention.

For example, in the above embodiment, the removal unit 14 is mounted on the cover 13 in a detachable manner. However, a structure that restricts the attaching or detaching of the removal unit 14 from the cover 13 may be available. Moreover, the removal roller 21, the label detection sensor 22, and the paper detection sensor 23 are mounted on the removal unit 14. However, there is no need to mount the label detection sensor 22 and the paper detection sensor 23, as long as at least the removal roller 21 is mounted.

What is claimed is:

1. A label printer comprising:

a printer body that includes a paper roll holder;

a label printing unit that includes a print head to print a label that remains temporarily attached to a paper strip that is fed from a paper roll in the paper roll holder;

a platen roller that sends the paper strip in a first direction after the paper strip passes through the print head;

a cover that opens or closes the paper roll holder;

and a removal unit that peels off the label from the paper strip, wherein one end of the cover is pivotally supported on the printer body via a first rotation shaft that is parallel to a central axis of the paper roll, one end of a longitudinal side of the removal unit is pivotally supported on the cover via a second rotation shaft that is perpendicular to the first rotation shaft, and a locking mechanism that engages with the cover is provided at the other end of the longitudinal side of the removal unit.

2. The label printer as claimed in claim 1, wherein the removal unit includes:

a removal roller that sends the paper strip in a second direction that is different from the first direction in such a way that the paper strip is being held between the removal roller and the platen roller, and peels off the label from the paper strip;

a label detection sensor that detects a state of the label being discharged through a first paper sheet exit opening located in the first direction;

a paper detection sensor that detects whether or not the paper strip is being discharged through a second paper sheet exit opening located in the second direction; and a frame on which the removal roller, the label detection sensor, and the paper detection sensor are mounted.

3. The label printer as claimed in claim 1, wherein the removal unit further includes a pressing spring that presses the removal roller into a direction so that the platen roller is pressed by the removal roller when the removal unit is closed.

4. The label printer as claimed in claim 1, wherein the removal unit is provided on the cover in a detachable manner.

5. The label printer as claimed in claim 4, wherein the cover has a fitting portion that is substantially C-shaped in cross section and the second rotation shaft of the removal unit is attached to the fitting portion.

6. The label printer as claimed in claim 1, wherein the paper roll holder is located in a rear portion of the printer body in such a way as to be located behind of the label printing unit, and the first rotation shaft is provided in a rear end portion of the printer body which is a rear portion of the printer body in such a way as to be located behind of located behind of the paper roll holder.

* * * * *